US012331422B2

(12) United States Patent
Tie Long et al.

(10) Patent No.: US 12,331,422 B2
(45) Date of Patent: Jun. 17, 2025

(54) TITANIUM SURFACE TREATMENT METHOD

(71) Applicant: DONGGUAN DSP TECHNOLOGY CO., LTD., Dongguan (CN)

(72) Inventors: Guo Tie Long, Shenzhen (CN); Tan Yonggang, Shenzhen (CN)

(73) Assignee: DONGGUAN DSP TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 18/055,144

(22) Filed: Nov. 14, 2022

(65) Prior Publication Data

US 2023/0151506 A1 May 18, 2023

(30) Foreign Application Priority Data

Nov. 16, 2021 (JP) ..... 2021-186704

(51) Int. Cl.

| | |
|---|---|
| ***C23F 17/00*** | (2006.01) |
| ***C23F 1/26*** | (2006.01) |
| ***C25D 5/38*** | (2006.01) |
| ***C25D 9/02*** | (2006.01) |

(52) U.S. Cl.

CPC ..... *C25D 9/02* (2013.01); *C23F 1/26* (2013.01); *C23F 17/00* (2013.01); *C25D 5/38* (2013.01)

(58) Field of Classification Search

None

See application file for complete search history.

(56) References Cited

U.S. PATENT DOCUMENTS

| | | | | |
|---|---|---|---|---|
| 5,800,693 | A * | 9/1998 | Kakizaki | C25D 11/30 205/50 |
| 10,280,514 | B2 * | 5/2019 | Miao | B05D 5/068 |
| 2009/0250351 | A1 * | 10/2009 | Ostrovsky | C25D 11/026 205/108 |

OTHER PUBLICATIONS

English translation CN 109554741, Yan et al. (Year: 2019).*
English translation CN 112387983 (Year: 2021).*
English translation CN 108486633 (Year: 2018).*
English translation CN 104772972 (Year: 2015).*

* cited by examiner

*Primary Examiner* — Stefanie S Wittenberg
(74) *Attorney, Agent, or Firm* — Greer, Burns & Crain, Ltd

(57) ABSTRACT

A titanium surface treatment method for manufacturing a polymer-titanium joint structure having excellent bond strength is provided. A titanium surface treatment method for bonding with a polymer composite includes a first etching step wherein the titanium surface is etched by acidic solution; a first surface treatment step wherein the titanium surface is treated by ultrasonic wave; a second etching step wherein the titanium surface is etched again by acidic solution; a second surface treatment step wherein the titanium surface is treated again by ultrasonic wave; a first silane coupling treatment step wherein the titanium surface is treated by ultrasonic wave; a third surface treatment step wherein the titanium surface is treated again by ultrasonic wave; and a second silane coupling treatment step wherein the titanium surface is treated by anodic oxidation.

2 Claims, 9 Drawing Sheets

TITANIUM SURFACE TREATMENT METHOD

BACKGROUND

The present invention relates to a titanium surface treatment method, and more particularly to a titanium surface treatment method for adhesively bonding a polymer-titanium joint structure, wherein the bonding between the titanium surface and the polymer is maximized through a first and second silane coupling treatment of the titanium surface.

Although polymer-titanium joint structures are widely used in automotive and electronic parts and components, low reliability in relation to the strength of the bonding between the polymer and titanium has been suggested as a problem.

Meanwhile, titanium surface treatment by anodizing is performed to increase the activity and friction of the titanium surface and to induce strong bonding with the polymer.

SUMMARY

The present invention has been made to solve the issue, and an object thereof is to provide a titanium surface treatment method for manufacturing a polymer-titanium joint structure having excellent bond strength.

A titanium surface treatment method for bonding with a polymer composite which comprises:

(a) a first etching step wherein the titanium surface is etched by acidic solution;

(b) a first surface treatment step wherein the titanium surface is treated by ultrasonic wave;

(c) a second etching step wherein the titanium surface is etched again by acidic solution;

(d) a second surface treatment step wherein the titanium surface is treated again by ultrasonic wave;

(e) a first silane coupling treatment step wherein the titanium surface is treated by ultrasonic wave;

(f) a third surface treatment step wherein the titanium surface is treated again by ultrasonic wave;

(g) a second silane coupling treatment step wherein the titanium surface is treated by anodic oxidation.

A titanium surface treatment method comprising:

the step (e) is performed in a solution containing 10-50 wt. % of an alkali in which caustic soda, line 3: (1-10% concentration), sodium carbonate (1-10% concentration) and ammonium nitrate (1-10% concentration) are mixed at a ratio of 3:1:1 and 0.1-1 wt. % of a primary silane coupling agent for 10-300 seconds at a frequency of 24-100 kHz, at 30-70° C. and at an output of 400 W by ultrasonic wave.

A titanium surface treatment method comprising:

the step (f) is performed in an acidic solution containing mixture of at least two or more in which sulfuric acid (1-10% concentration), phosphoric acid (1-10% concentration) and nitric acid (1-10% concentration) or in an alkali solution containing mixture of at least two or more in which caustic soda (1-10% concentration), sodium carbonate (1-10% concentration) and, line 6: ammonium nitrate (1-10% concentration) for 10-300 seconds at a frequency of 24-100 kHz, at 30-70° C. and at an output of 400 W by ultrasonic wave.

A titanium surface treatment method comprising:

the step (g) is performed in a solution containing 10-50 wt. % of an electrolyte solution in which NaOH, KOH, $Ca(OH)_2$ and $NaHCO_3$ are mixed at a ratio of 3:1:1:1 and 0.1-1 wt. % of a second silane coupling agent for 1 to 30 minutes at a current density of 0.1 to 10 $A/dm^2$ using a rectifier for a positive duration (application time) of 500 ms pulse at 30 to 70° C.

A titanium surface treatment method according to comprising:

the silane coupling agent is a mixture of at least two or more in which of $(RO)_3Si—(CH_2)_3—NH_2$, $(RO)_3Si—(CH_2)_2—Si(OC_2H_5)_3$, $(RO)_3Si—(CH_2)_3—SH$, $(RO)_3Si—CH=CH_2$, $(RO)_3Si—(CH_3)_3—OOC(CH_3)C=CH_2$, $(RO)_3Si—(CH_3)_3—O—CHCH_2O$ and $(RO)_3Si—(CH_2)_{15}CH_3$.

A titanium surface treatment method comprising:

the first silane coupling agent and the second silane coupling agent are different kinds of mixture.

Effects of the Invention

A titanium alloy surface is subjected to etching using an acidic solution to the titanium alloy surface, the titanium alloy surface is roughened, and the surface is roughened together with the microcrack by primary surface treatment with ultrasonic waves.

Afterwards, large amount of fine cracks are formed on the surface through primary and secondary silane coupling treatment using ultrasonic waves, and the silane coupling agent is infiltrated into the generated crack to maximize the bonding force between the polymer and titanium.

DETAILED DESCRIPTION

Figure 1:
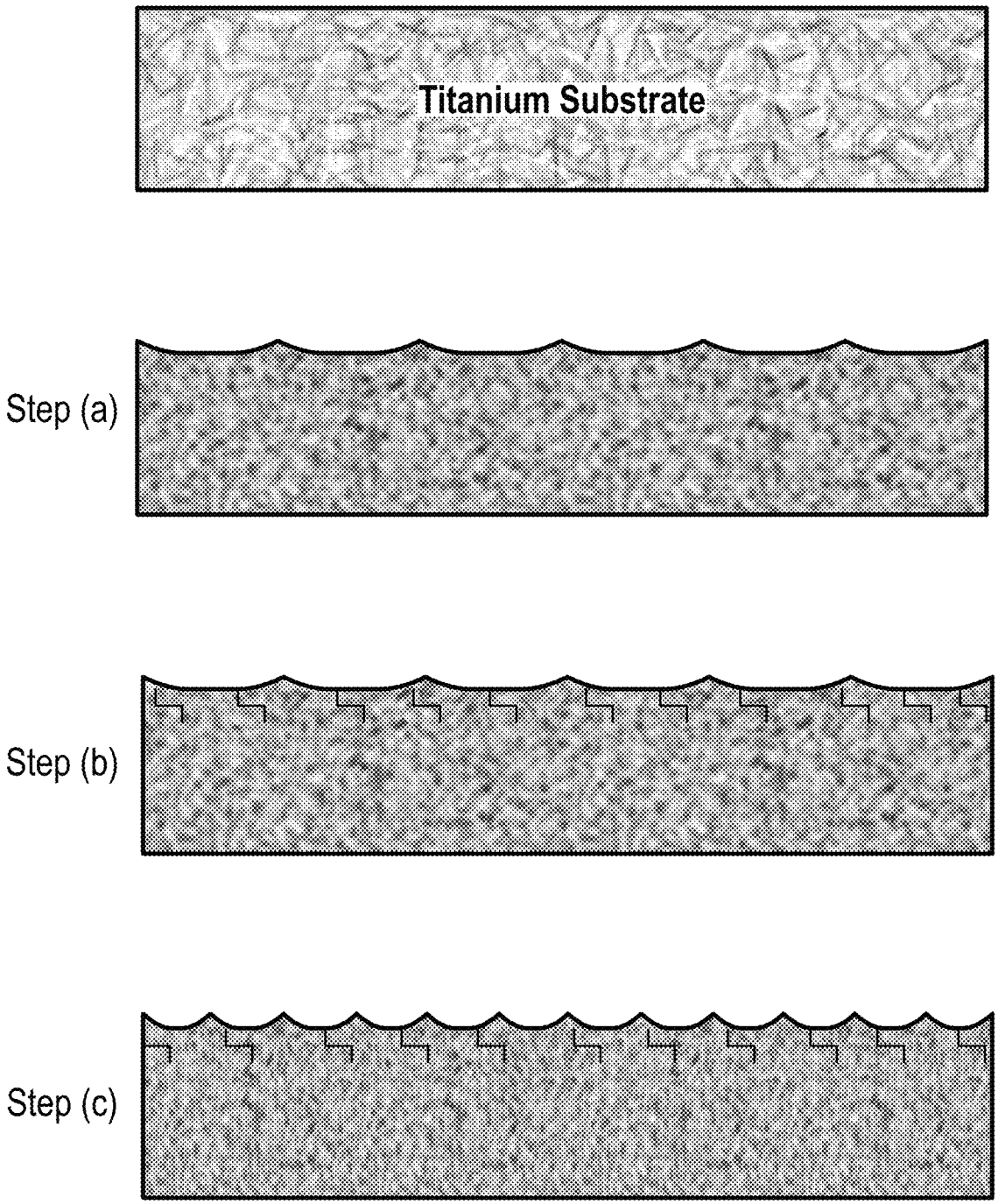
FIG. 1 shows the change of the surface according to each process of the titanium surface treatment.
Figure 1:
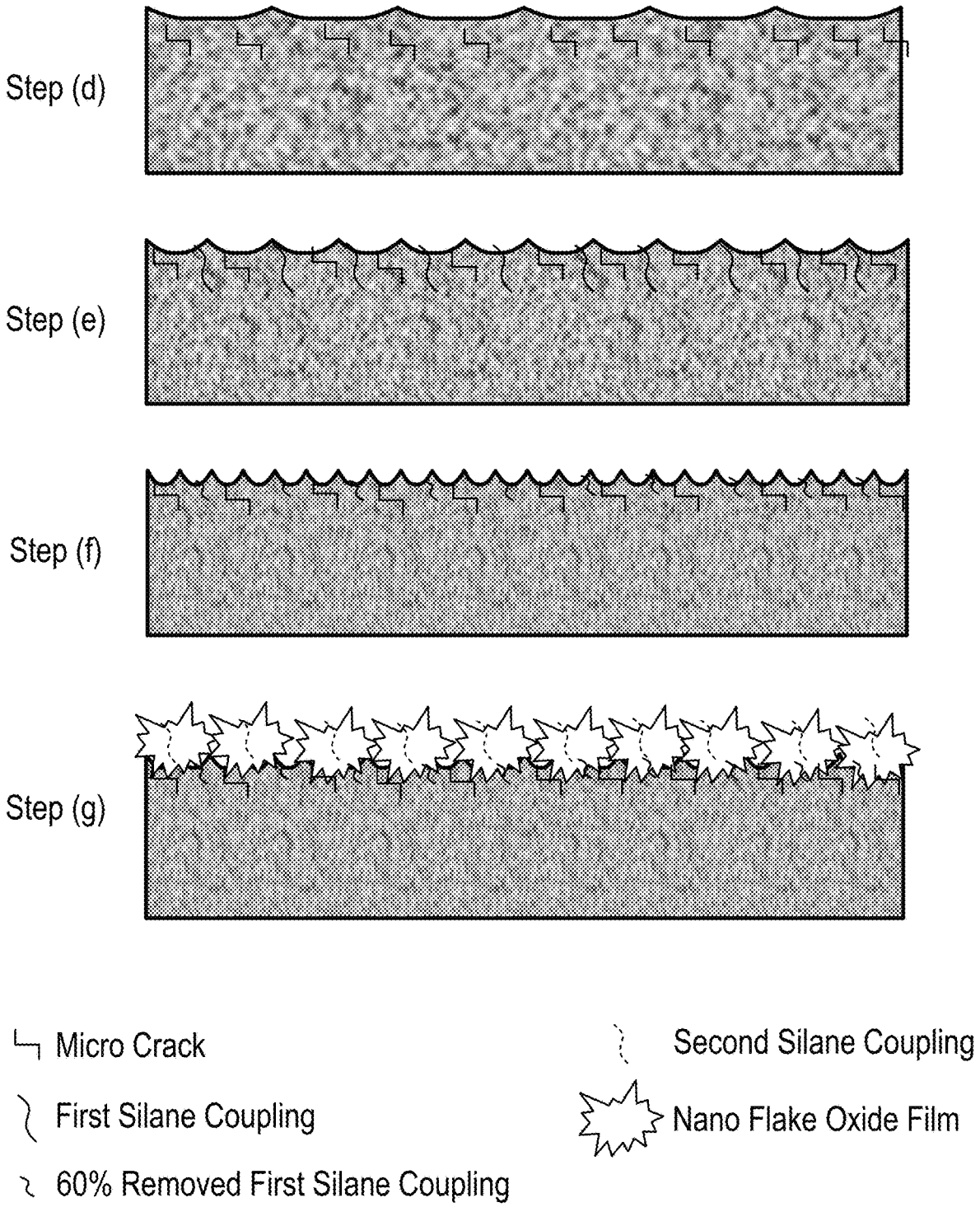

A manufacturing method of the polymer titanium junction is described by referring to the drawing.

A titanium surface treatment method for bonding with a polymer composite which comprises:

(a) a first etching step wherein the titanium surface is etched by acidic solution;

(b) a first surface treatment step wherein the titanium surface is treated by ultrasonic wave;

(c) a second etching step wherein the titanium surface is etched again by acidic solution;

(d) a second surface treatment step wherein the titanium surface is treated again by ultrasonic wave;

(e) a first silane coupling treatment step wherein the titanium surface is treated by ultrasonic wave;

(f) a third surface treatment step wherein the titanium surface is treated again by ultrasonic wave;

(g) a second silane coupling treatment step wherein the titanium surface is treated by anodic oxidation.

In the step (a), a first etching treatment is performed in an acidic solution containing general sulfuric acid, phosphoric acid and a trace amount of nitric acid at 30-60° C. for 10-300 seconds.

In the first etching step, etching marks are formed on the titanium surface and make the titanium surface rough.

In the step (b), a first surface treatment using ultrasonic waves is performed in a general alkali solution by a frequency of 24-100 kHz at 30-60° C. and at an output of 400 W for 10-300 seconds.

A microcrack is formed on the titanium surface wherein etched by the first surface treatment.

In the step (c), a second etching treatment is performed in an acidic solution containing general sulfuric acid, phosphoric acid and a trace amount of nitric acid at 30-60° C. for 10-300 seconds.

In the second etching step, further etching marks are formed on the titanium surface and make the titanium surface further rough.

In the step (d), a second surface treatment using ultrasonic waves is performed in a general alkali solution by a frequency of 24-100 kHz at 30-60° C. and at an output of 400 W for 10-300 seconds.

A further microcrack is formed on the titanium surface wherein etched by the first surface treatment.

In the step (e), a first silane coupling treatment is performed in a solution containing 10-50 wt. % of an alkali solution in which caustic soda (1-10% concentration), sodium, line 3: carbonate (1-10% concentration) and ammonium nitrate (1-10% concentration) are mixed at a ratio of 3:1:1 and 0.1-1 wt. % of a first silane coupling agent for 10-300 seconds at a frequency of 24-100 kHz, at 30-70° C. and at an output of 400 W by ultrasonic wave.

A microcrack is further formed on the etched titanium surface, and a silane coupling agent is infiltrated into the formed microcrack.

In the step (e), the first silane coupling agent is a mixture of at least two or more in which of $(RO)_3Si—(CH_2)_3—NH_2$, $(RO)_3Si—(CH_2)_2—Si(OC_2H_5)_3$, $(RO)_3Si—(CH_2)_3—SH$, $(RO)_3Si—CH{=}CH_2$, $(RO)_3Si—(CH_3)_3—OOC(CH_3)C{=}CH_2$, $(RO)_3Si—(CH_3)_3—O—CHCH_2O$ and $(RO)_3Si—(CH_2)_{15}CH_3$.

In the step (f), the third surface treatment using ultrasonic waves is performed in an acidic solution containing mixture of at least two or more in which sulfuric acid (1-10% concentration), phosphoric acid (1-10% concentration) and nitric acid (1-10% concentration) or in an alkali solution containing mixture of at least two or more in which caustic soda (1-10%, line 5: concentration), sodium carbonate (1-10% concentration) and ammonium nitrate (1-10% concentration) for 10-300 seconds at a frequency of 24-100 kHz, at 30-70° C. and at an output of 400 W by ultrasonic wave.

Roughness of the titanium surface is roughened by etching and ultrasonic waves, and about 60% of the primary silane coupling agent infiltrated into the titanium surface is removed.

In the step (g), a second silane coupling treatment is performed in a solution containing 10-50 wt. % of an electrolyte solution in which NaOH, KOH, $Ca(OH)_2$ and $NaHCO_3$ are mixed at a ratio of 3:1:1:1 and 0.1-1 wt. % of a second silane coupling agent for 1 to 30 minutes at a current density of 0.1 to 10 $A/dm^2$ using a rectifier for a positive duration (application time) of 500 ms pulse at 30 to 70° C.

A nano flake oxide film is formed on the titanium surface, and a secondary silane coupling agent different from the first silane coupling agent further penetrates microcracks on the titanium surface and has strong binding force between the titanium surface and the polymer.

In the step (g), the second silane coupling agent is a mixture of at least two or more in which of $(RO)_3Si—(CH_2)_3—NH_2$, $(RO)_3Si—(CH_2)_2—Si(OC_2H_5)_3$, $(RO)_3Si—(CH_2)_3—SH$, $(RO)_3Si—CH{=}CH_2$, $(RO)_3Si—(CH_3)_3—OOC(CH_3)C{=}CH_2$, $(RO)_3Si—(CH_3)_3—O—CHCH_2O$ and $(RO)_3Si—(CH_2)_{15}CH_3$.

The second silane coupling agent in the step (g) are different kinds of mixture from the first silane coupling agent in the step (e).

By different silane coupling agents, a binding force between the titanium surface and the polymer is stronger.

After a second silane coupling treatment, oxidation is generated through fine microcracks generated in oxide film protrusions on the titanium surface, and fine oxide film protrusions are additionally generated from the microcracks. Consequently, the contact area is maximized on the surface of the titanium to maximize the bonding force between the titanium and the polymer. And a Bandelivance superposition force is generated between the additive remaining in the anodizing titanium oxide film and the polymer to generate additional bonding force.

A structure and a change of the surface of the titanium alloy due to respective processes of the surface treatment of the titanium alloy are illustrated in FIG. 1.

Figure 2A:
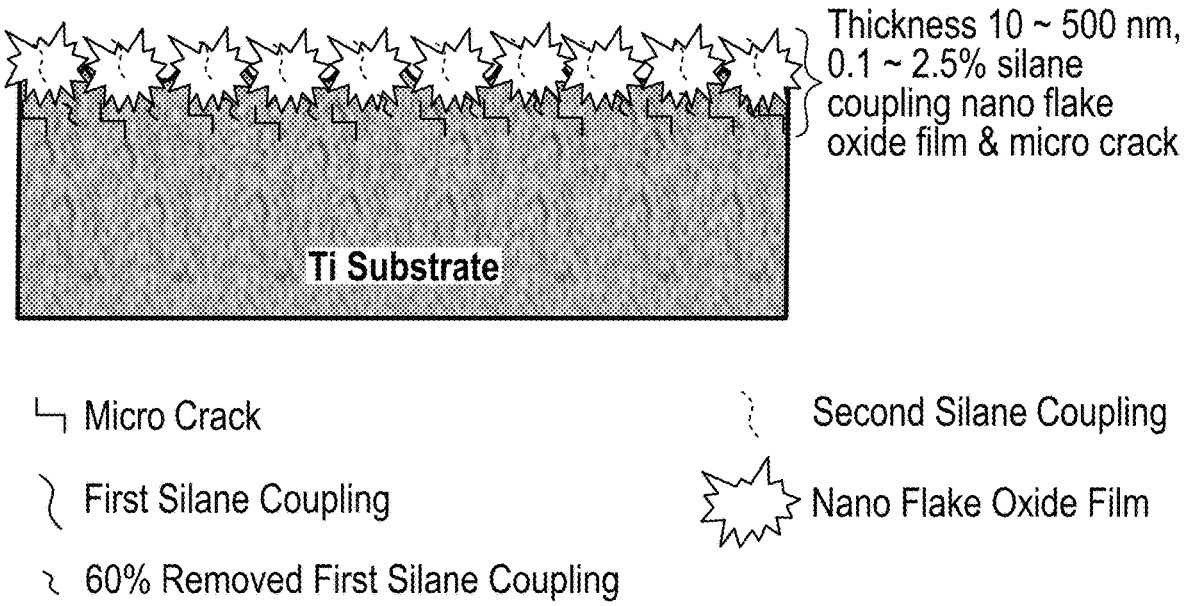
FIG. 2A shows a cross-sectional photograph of the final titanium surface with the Nano Flake Oxide film shown schematically as treating the surface in FIG. 1.

A detailed state diagram of the titanium surface after the final surface treatment process is illustrated in FIG. 2A.

As shown in the figure, the thickness of the oxide film such as a microcrack and a snow flower permeated with the silane coupling agent is 10-500 nm.

Figure 2B:
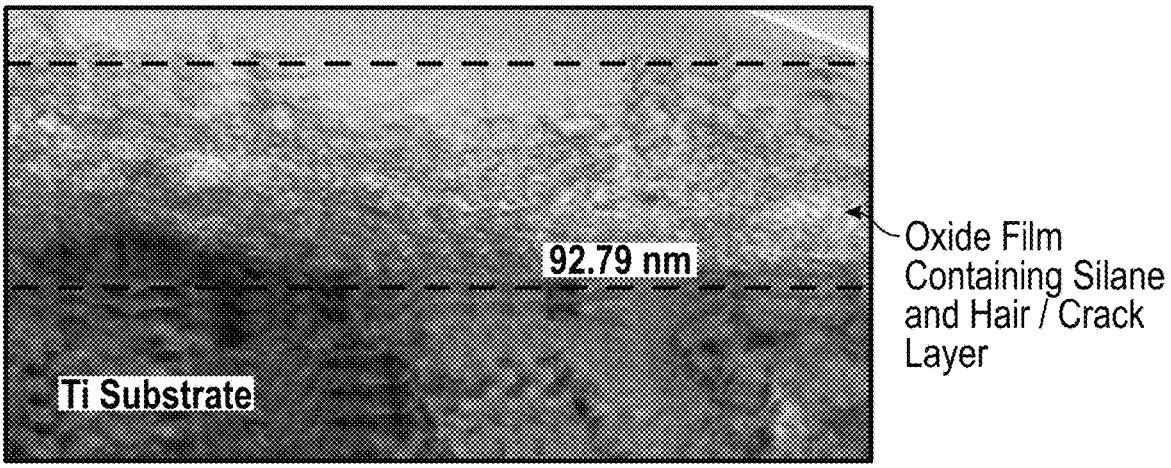
FIG. 2B shows an enlarged cross-sectional photograph of the final titanium surface of FIG. 1.
Figure 3:
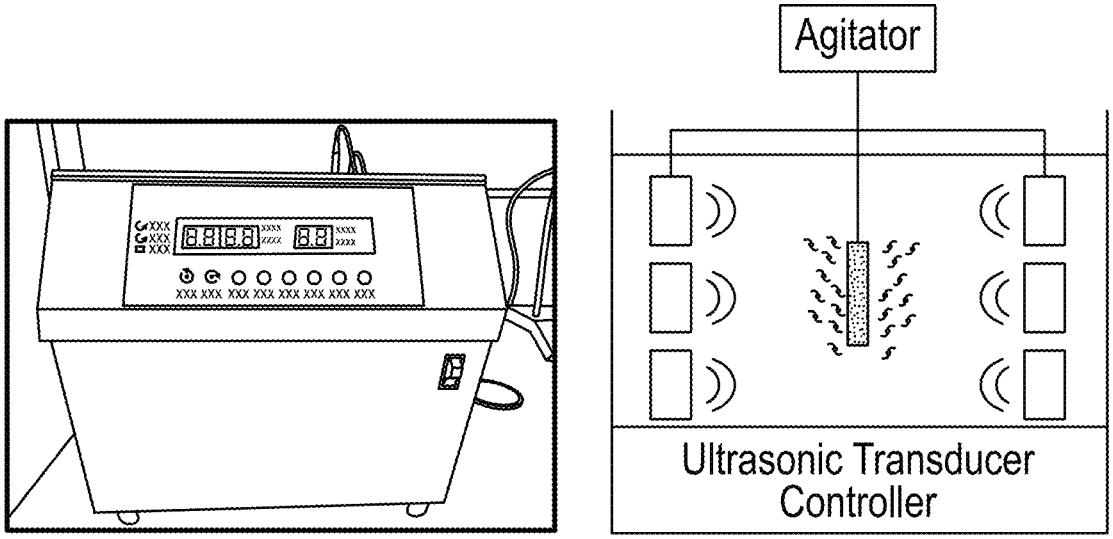
FIG. 3 shows an ultrasonic device.
Figure 4A:
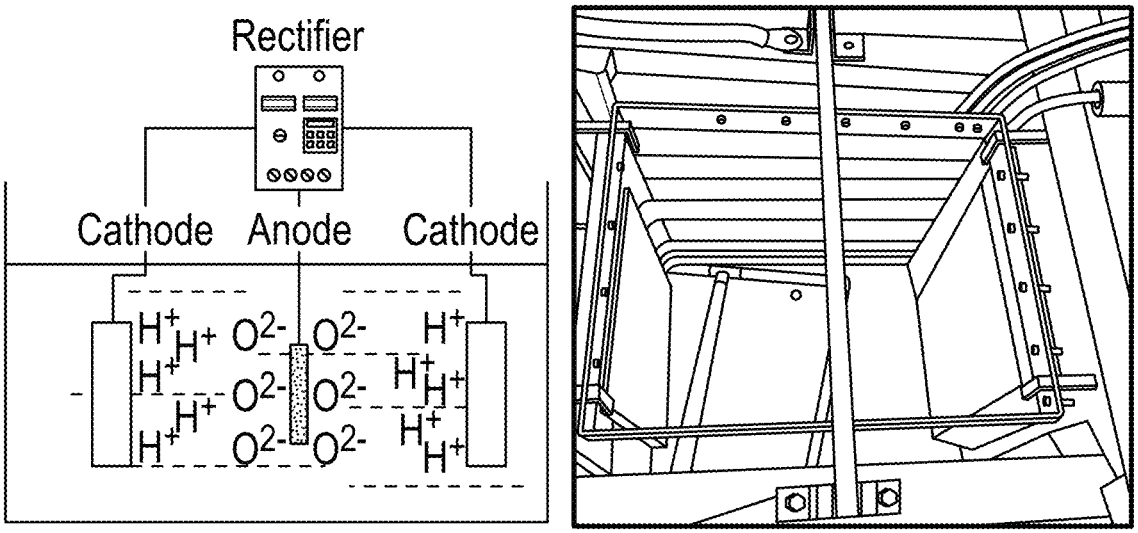
FIGS. 4A-4B show anodizing devices in FIG. 4A and conditions in FIG. 4B.
Figure 4B:
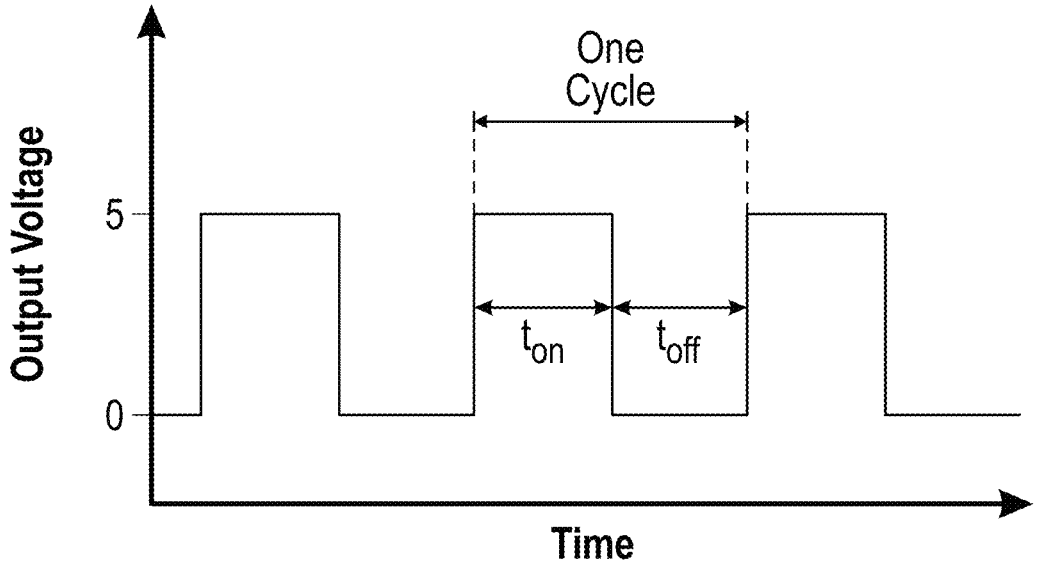

A cross-sectional photograph of the titanium surface after the final surface treatment process is illustrated in FIG. 2B.

Formation of oxide coatings such as microcracks and nano flakes can be confirmed.

Specific embodiments and drawings are described below.

In order to prove the effect of the present invention, the experiment was carried out by making 10 test pieces for each experiment for a conventional example and an embodiment 1-3.

As the usable titanium metal, titanium alloy from Ti-grade 1 to Ti-grade 23 can be used.

The titanium alloy sample of Ti-grade2 was used as the specimen used in the experiment.

The components of the Ti-grade 2 are shown in the table 1 below.

TABLE 1

| N | C | H | Fe | O | Ti |
|---|---|---|---|---|---|
| 0.03% | 0.08% | 0.015% | 0.3% | 0.25% | Bal. |

Polymers usable in this invention are composite resins, polyethylene, polypropylene, polyvinyl chloride, polyvinyl acetate, polyacrylic acid ester, polymethacrylic acid ester, unsaturated polymer, polyamide, polyether, polyether, polystyrene, polystyrene, polystyrene, polystyrene, polyester, polystyrene, polystyrene, polystyrene, polystyrene, polystyrene, polystyrene, polystyrene, polystyrene, polystyrene-.Her, Polyphenylene oxide, Polyphenylene sulfide, Polybutadiene, Polybutylene terephthalate, Polymethylpentene, Liquid crystal polymer, etc. can be used.

TABLE 2

| Material | Tensile strength (Mpa) | Melt temperature(° C.) | Heat distortion temperature(° C.) | Density (g/cm$^3$) | Elongation at rupture(%) |
|---|---|---|---|---|---|
| PPS | 170 | 310 | 140 | 1.57 | 2 |

Conventional Example

After step (a)~step (d), a test specimen is made by a conventional method. A conventional method is performed in a solution containing 30 wt. % of an electrolyte solution in which NaOH, KOH, $Ca(OH)_2$ and $NaHCO_3$ are mixed at a ratio of 3:1:1:1 for 15 minutes at a current density of 5 A/dm$^2$ using a 500 ms pulse rectifier for a positive duration (application time) of 500 ms at 50° C.

Embodiment 1

After step (a)~step (d), a test specimen is made by invention method. In the step (e), a first silane coupling treatment is performed in a solution containing 25 wt. % of an alkali solution in which caustic soda (5% concentration), sodium carbonate (5% concentration) and, line 4: ammonium nitrate (5% concentration) are mixed at a ratio of 3:1:1 and 0.5 wt % of a first silane coupling agent (a mixture of $(RO)_3Si—(CH_2)_2—Si(OC_2H_5)_3$ and $(RO)_3Si—(CH_2)_3—SH$ at a ratio 1:3) for 150 seconds at a frequency of 60 kHz, at 30-70° C. and at an output of 400 W by ultrasonic wave.

Embodiment 2

After step (a)~step (e), a test specimen is made by invention method. In the step (f), the third surface treatment using ultrasonic waves is performed in an acidic solution containing mixture in which sulfuric acid (5% concentration) and phosphoric acid (5% concentration) for 150 seconds at a frequency of 60 kHz, at 50° C. and at an output of 400 W by ultrasonic wave.

Embodiment 3

After step (a)~step (f), a test specimen is made by invention method. In the step (g), a second silane coupling treatment is performed in a solution containing 25 wt. % of an electrolyte solution in which NaOH, KOH, $Ca(OH)_2$ and $NaHCO_3$ are mixed at a ratio of 3:1:1:1 and 0.5 wt. % of a second silane coupling agent (a mixture of $(RO)_3Si—(CH_2)_3—NH_2$ and $(RO)_3Si—(CH_2)_2—Si(OC_2H_5)_3$ at a ratio 3:1) for 15 minutes at a current density of 5 A/dm$^2$ using a rectifier for a positive duration (application time) of 500 ms pulse at 50° C.

With conventional example and the embodiment 1-3, the following resistance value measurement, T-bend test, tensile test, coupling force measurement and sealing experiment based on leaving time were performed, respectively. The results are as follows.

[Test 1]

Figure 5A:
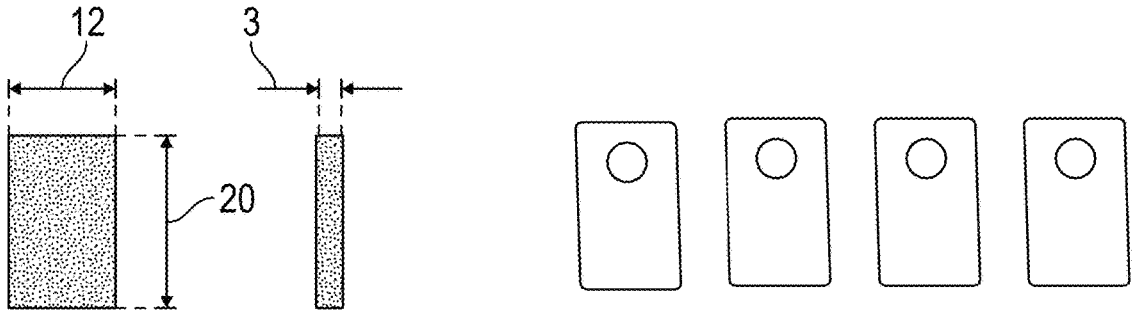
FIGS. 5A-5C show in FIG. 5A Titanium specimens of the conventional products and inventions of the present application, in FIG. 5B A specimen combining the conventional product and the invention of the present application with each polymer, and in FIG. 5C After each constant temperature and humidity test of the conventional product and the invention of the present application, a tensile test method.
Figure 5B:
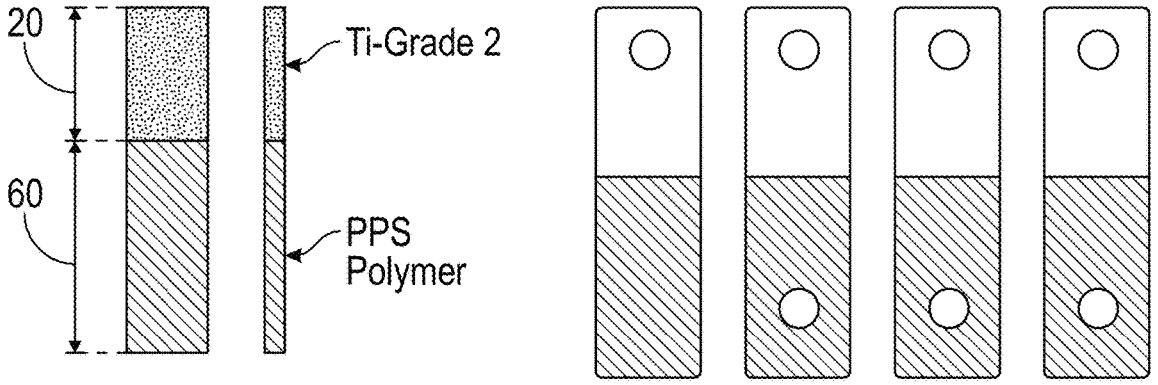

The specimen used in the conventional examples and Embodiments 1 to 3 is a titanium alloy of Ti-grade2 as shown in FIG. 5A, with a width of 12 mm, a length of 20 mm, and a thickness of 3 mm, and is vertically combined as shown in FIG. 5B of the titanium specimen produced by the process of the conventional examples and Embodiments 1 to 3.

Figure 5C:
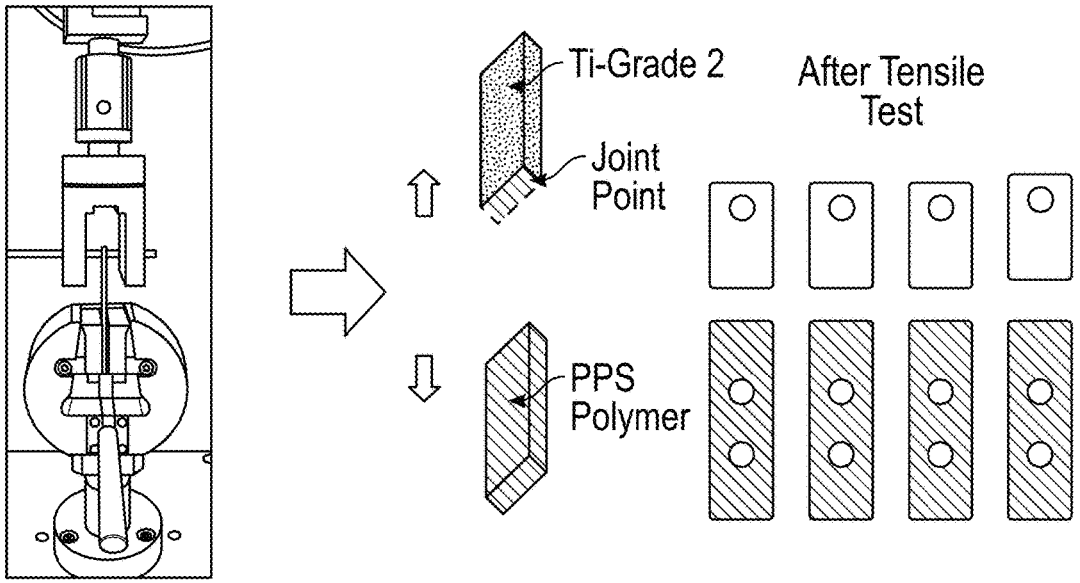
Figure 6:
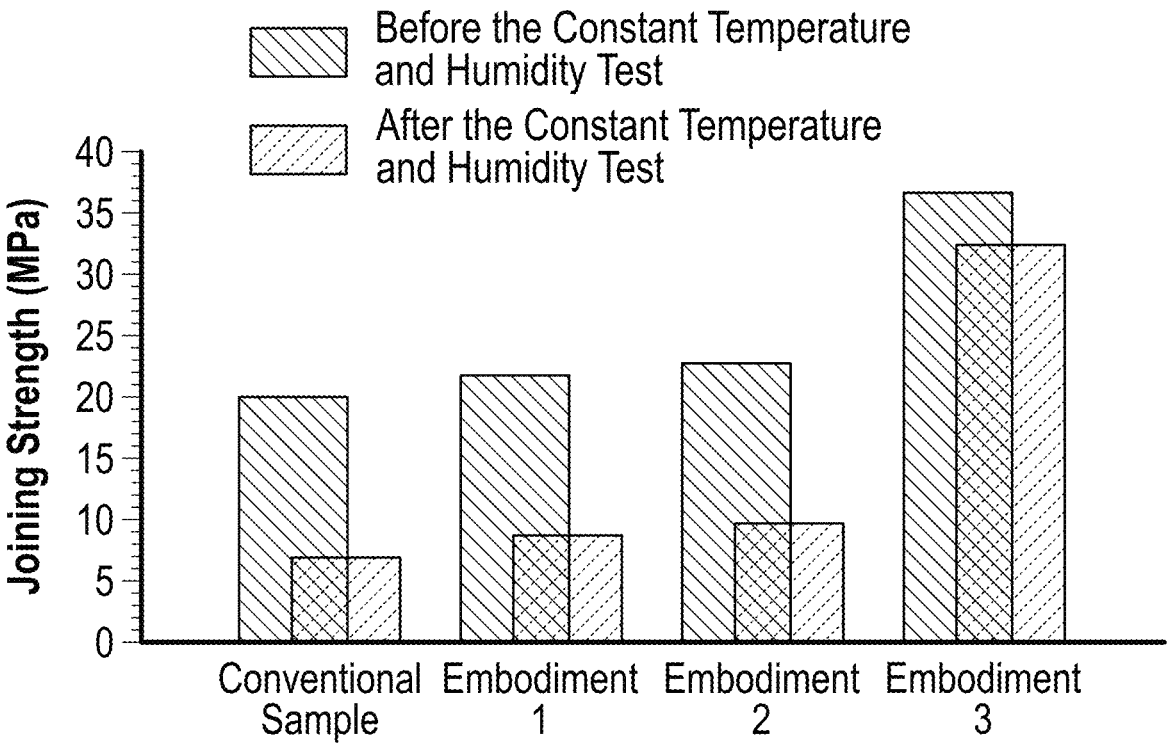
FIG. 6 shows the results of tensile test after constant temperature and humidity test of the conventional product and the invention of the present application respectively.

In order to measure the bonding strength, a tensile test is performed before/after 1000HR of constant temperature and humidity, as shown in FIG. 5C, and the results are shown in FIG. 6.

FIG. 5A is a test piece manufactured for a tensile experiment, and FIG. 5B is a polymer is superimposed on each titanium test piece in an embodiment.

FIG. 5C shows a photograph of the tensile experiment method.

As shown in the graph of FIG. 6, it may be seen that the specimen of embodiment 1 has better tensile force before/after the constant temperature and humidity test than the specimen of the conventional example.

In addition, it may be seen that the specimen of embodiment 2 has a better tensile force before/after the constant temperature and humidity test than the specimen of embodiment 1.

Finally, it may be seen that the specimen of embodiment 3 has the best tensile force before/after the constant temperature and humidity test than the specimen of embodiment 2.

Figure 7:
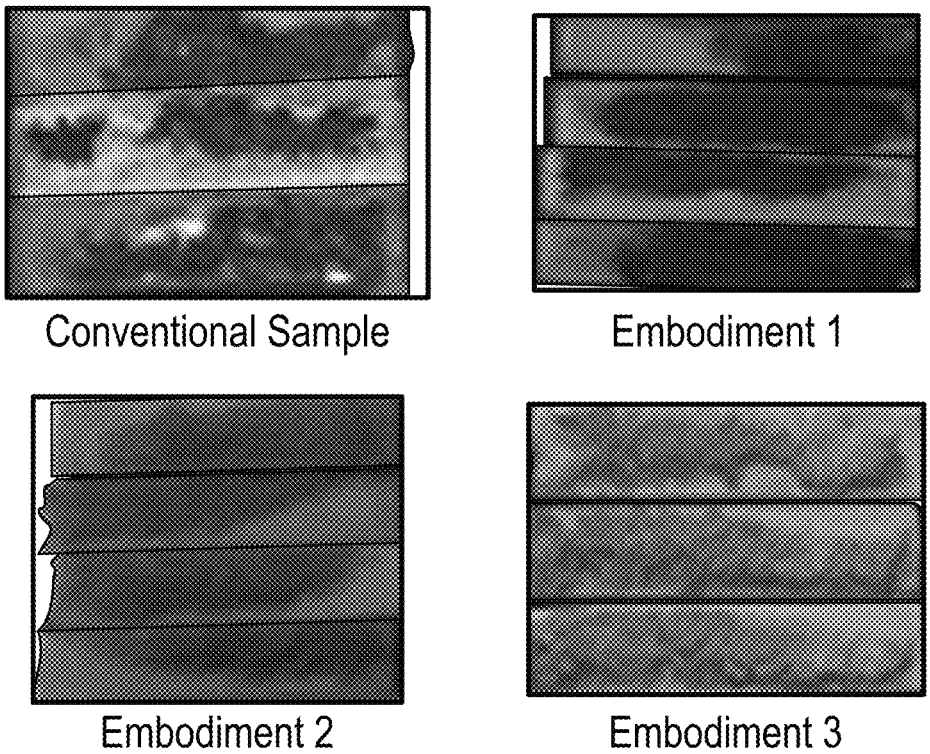
FIG. 7 shows a photograph of the fracture surface by tensile experiment after each constant temperature and humidity test of the conventional product and the invention of the present application.

FIG. 7 show a photograph of the amount of polymer remaining on the separated titanium surface of the test pieces according to the conventional example and the embodiments 1-3 after the tensile experiment is completed after the constant temperature and humidity test.

In case of the separation surface of the test piece of the conventional example, and it is easily separated, and it can be seen that the amount of polymer is about 30% on the titanium surface after separation.

In case of the separation surface photograph of the test piece of the embodiment 1, and it can be seen that the amount of polymer is about 40% on the titanium surface after separation.

In case of the separation surface photograph of the test piece in embodiment 2, and it can be seen that the amount of polymer is about 50% on the titanium surface after separation.

In case of the separation surface photograph of the test piece in embodiment 3, and it can be seen that the amount of polymer is about 80% on the titanium surface after separation.

Figure 8:
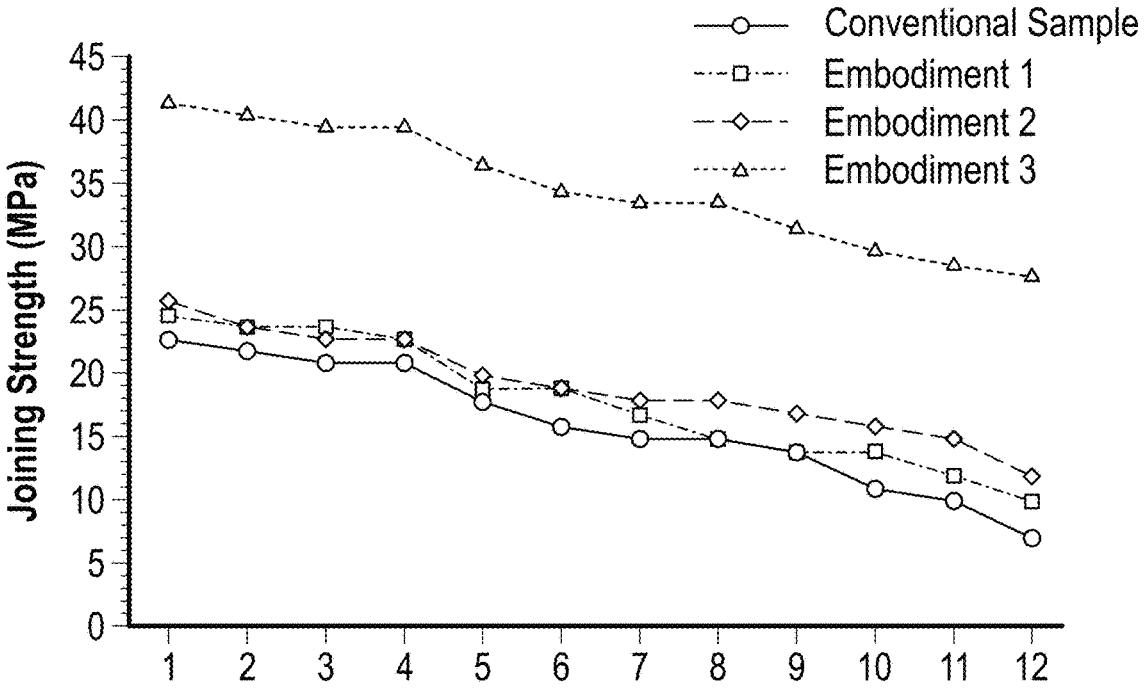
FIG. 8 shows a comparison graph of tensile experiments between conventional products and inventions of the present application by each neglect time.

FIG. 8 show the results of the tensile strength test over time between 1 month and 12 months after polymer superposition for the test samples.

In such a manner, it can be seen that the test piece of the embodiment 1 is superior to the test piece of the conventional example in a decrease in tensile force due to the lapse of time.

Further, it can be seen that the tensile force of the embodiment 1 is decreased more due to the lapse of time than the conventional example.

Further, it can be seen that the tensile force of the embodiment 2 is decreased more due to the lapse of time than that of the embodiment 1.

Finally, it can be seen that the test piece of the embodiment 3 has the most decrease in tensile force due to the lapse of time than that of the embodiment 2.

[Test 2]

Figure 10:
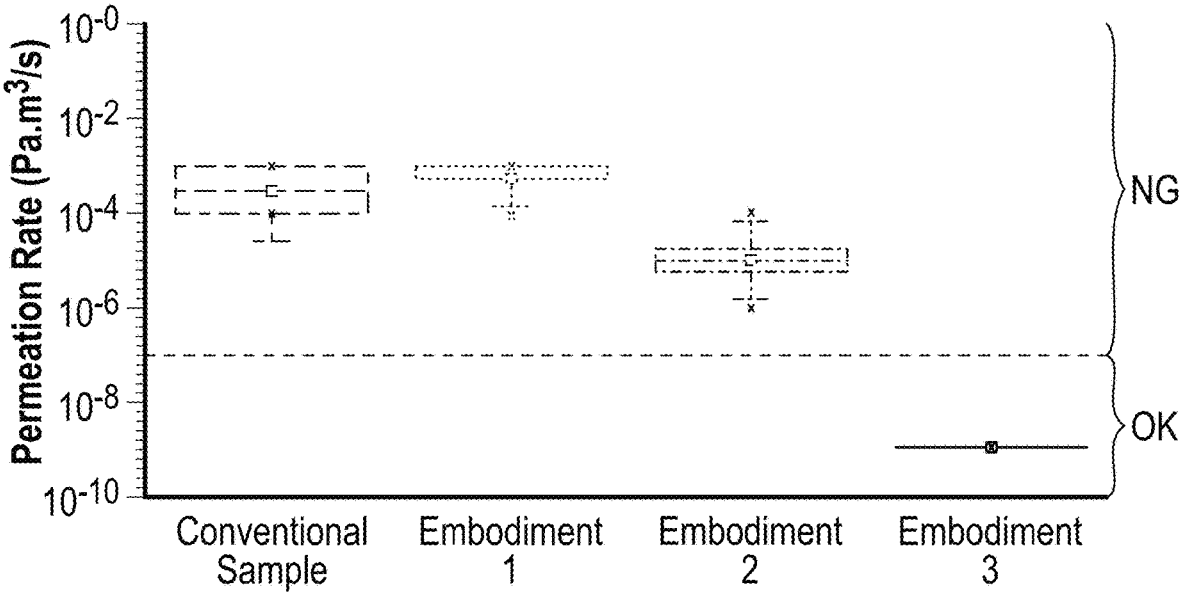
FIG. 10 shows comparison graphs of each of the conventional products and the inventions of the present invention as a result of constant temperature and humidity test.

In order to measure a sealed state between the titanium alloy and the polymer using the specimens of the conventional Examples and Examples 1 to 3, a sealing experiment is performed after 1000HR at a constant temperature and humidity, and the result is shown in FIG. 10.

The specimen used in the conventional examples and Embodiments 1 to 3 is a titanium alloy of Ti-grade 2 as shown in FIG. 9(*a*), with a width of 12 mm, a length of 40 mm, and a thickness of 3 mm, and is injection-molded and bonded to the center of the titanium specimen manufactured by the processes of the conventional examples and Embodiments 1 to 3.

In order to measure the bonding strength, a sealing experiment was performed as shown in (b) of FIG. 9 after 1000HR of constant temperature and humidity, and the results are shown in FIG. 10.

As shown in the graph in FIG. 10, it can be seen that the sealing property of the embodiment 1 is superior to that of the specimen of the conventional example.

Further, it can be seen that the test piece of the embodiment 2 has better sealing properties than the test piece of the embodiment 1.

Finally, it can be seen that the test piece of the embodiment 3 is the most excellent in hermetic properties compared with the test piece of the embodiment 2.

Figure 9A:
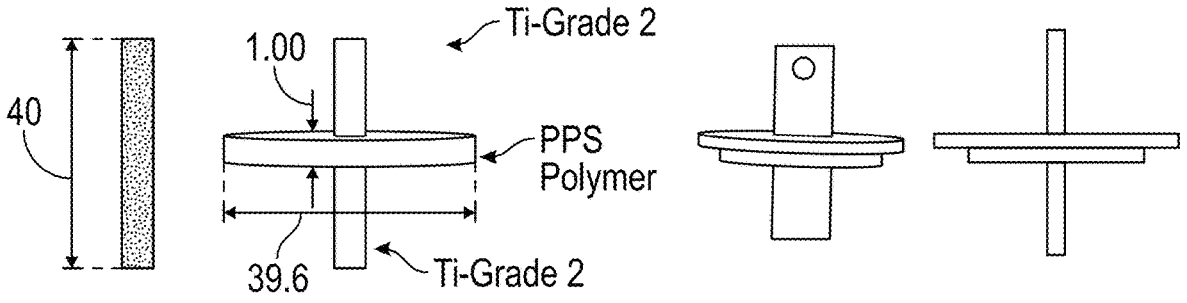
FIGS. 9A-9B show a constant temperature and humidity test measuring machine and a test piece.

FIG. 9A is a specimen photograph for constant temperature and humidity experiments.

Figure 9B:
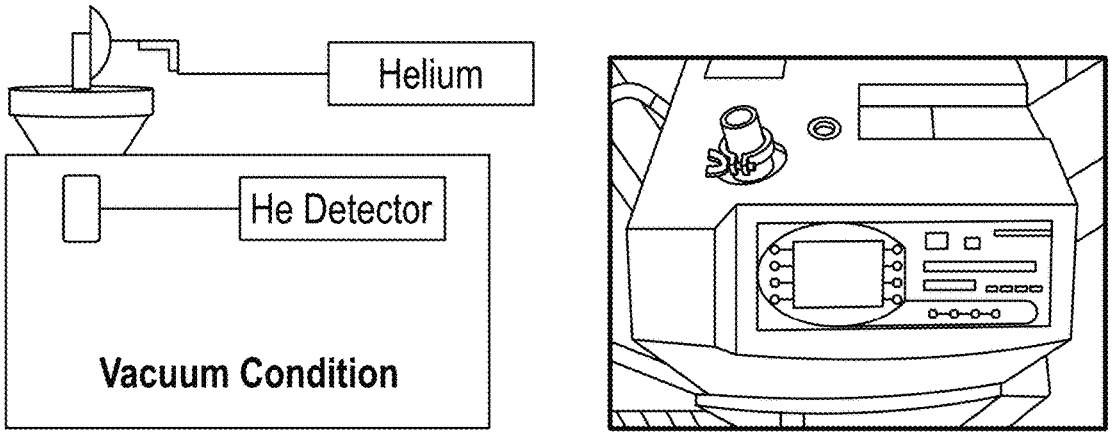

FIG. 9B shows a photograph of the constant temperature and humidity experiment equipment.

INDUSTRIAL APPLICABILITY

The present invention is a method of fabricating a polymer-titanium joint structure, and it can promote weight reduction of parts and cost reduction by enhancing the bond strength and the sealing property between the polymer and titanium.

The invention claimed is:

1. A titanium surface treatment method for bonding with a polymer composite which comprises:

(a) a first etching step wherein the titanium surface is etched by acidic solution;

(b) a first surface treatment step wherein the titanium surface is treated by ultrasonic wave;

(c) a second etching step wherein the titanium surface is etched again by acidic solution;

(d) a second surface treatment step wherein the titanium surface is treated again by ultrasonic wave;

(e) a first silane coupling treatment step wherein the titanium surface is treated by ultrasonic wave;

(f) a third surface treatment step wherein the titanium surface is treated again by ultrasonic wave; and (g) a second silane coupling treatment step wherein the titanium surface is treated by anodic oxidation;

wherein the first silane coupling treatment step (e) is performed in a first silane coupling solution containing 10-50 wt % of NaOH, $Na_2CO_3$ and $NH_4NO_3$, mixed at a weight ratio of 3:1:1 and a first silane coupling agent at a concentration of 0.1-1 wt %, wherein the first silane coupling treatment step (e) performs ultrasonic wave for 10-300 seconds at a frequency of 24-100 kHz, at 30-70° C. and at an output of 400 W, wherein the second silane coupling treatment step (g) is performed in a second silane coupling solution containing 10-50 wt % of NaOH, KOH, $Ca(OH)_2$ and $NaHCO_3$, that are mixed at a weight ratio of 3:1:1:1, and a second silane coupling agent at a concentration of 0.1-1 wt %, wherein the second silane coupling treatment step (g) performs the anodic oxidation for 1 to 30 minutes at a current density of 0.1 to 10 $A/dm^2$ using a rectifier for a positive 1 Hz pulse current with durations of 500 ms at 30 to 70° C.

2. The titanium surface treatment method according to claim 1 comprising:

the first silane coupling agent and the second silane coupling agent are different from each other.

* * * * *